US005141074A

United States Patent [19]

Sulowski et al.

[11] Patent Number: 5,141,074

[45] Date of Patent: Aug. 25, 1992

[54] LINEMAN'S POLE STRAP ASSEMBLY

[75] Inventors: Andrew C. Sulowski, Etobicoke; Donald R. Ford, Midhurst, both of Canada

[73] Assignee: Ontario Hydro, Toronto, Canada

[21] Appl. No.: 840,139

[22] Filed: Feb. 24, 1992

[51] Int. Cl.[5] ..... A62B 35/00

[52] U.S. Cl. ..... 182/9; 182/133

[58] Field of Search ..... 182/9, 3, 5-8, 182/133-136, 187

[56] References Cited

U.S. PATENT DOCUMENTS

| | | | |
|---|---|---|---|
| 3,407,898 | 10/1968 | Johnson | 182/9 |
| 4,712,646 | 12/1987 | Page | 182/9 |
| 869,382 | 10/1907 | Newton . | |
| 1,120,496 | 12/1914 | Holsclaw . | |
| 1,721,516 | 7/1927 | Jacobs . | |
| 2,920,714 | 1/1960 | Johnson . | |
| 3,840,091 | 10/1974 | Conlon . | |
| 4,137,995 | 2/1979 | Fonte . | |
| 4,579,196 | 4/1986 | Allen et al . | |

*Primary Examiner*—Alvin C. Chin-Shue
*Attorney, Agent, or Firm*—Ridout & Maybee

[57] ABSTRACT

In a lineman's pole strap assembly for use on utility poles and the like, the assembly comprising an outer strap and a cross strap attached at its ends to the outer strap so as to define a closed loop encircling the pole, the cross strap is connected to the outer strap by slide members which are interconnected by an elastic tensile member under tension. In normal ascent and descent the cross strap is manually held away from the pole, but is releasable so as to be pulled into tight frictional engagement with the pole and to pull gaffs which are mounted on the slide members into listing engagement with the pole.

7 Claims, 6 Drawing Sheets

LINEMAN'S POLE STRAP ASSEMBLY

This invention relates to an improved pole strap assembly for use by a lineman.

A conventional pole strap is generally of relatively stiff but flexible material and is attached by snap hooks at its ends to rings on the lineman's body belt. In use the pole strap is passed round the far side of the utility pole or the like to be climbed and supports the lineman at a working position. When climbing the pole, or descending, the lineman adopts a side to side rolling movement while flipping the strap up and down between successive positions as he climbs up or down the pole. In order to support the lineman if he loses his footing on the pole, such pole straps are commonly fitted with braking means which are intended to engage the pole and support the lineman while he regains his footing.

Various safety devices having braking features have been proposed for braking the fall of a lineman. Such devices are described, for example, in U.S. Pat. Nos. 869382 (Newton), 1120496 (Holsclaw), 1721517 (Jacobs), 2920714 (Johnson), 3407898 (Johnson), 3840091 (Conlon), 4579196 (Allen) and 4712646 (Page). Many of these devices rely up the use of biting elements which are positioned so as to bite into the wood of the utility pole in the event of a fall, thereby supporting the lineman while he regains his footing. However, such devices are not effective unless the biting elements are brought into contact with the surface of the pole. To this end the pole strap is generally fitted with a cross-strap extending across the rear face of the pole, the assembly forming a closed loop encircling the pole and adapted to engage the pole snugly in the event of a fall.

It is an object of the present invention to provide an improved pole strap assembly incorporating a cross-strap which automatically engages the pole in the event of a fall and is effective on wooden utility poles.

A lineman's pole strap assembly according to the present invention comprises an outer strap of relatively stiff but flexible material adapted to extend loosely around the far side of a pole to be climbed and having end portions providing attachment means for attachment to a body belt worn by a lineman, and a cross strap which is secured at its ends to slide members slidably mounted on the outer strap so as to define with an intermediate portion of the outer strap a closed loop for encircling the pole. The slide members are interconnected by an elastic tensile member, such as a coil spring or a bungee cord, which extends around the intermediate portion of the outer strap along its outer surface. In normal ascent or decent of the pole the lineman holds the cross strap away from the pole with his hands while employing the pole strap in the conventional way. If he loses his footing, he releases the cross strap, which is automatically drawn into frictional engagement with the pole by the elastic tensile member. In this way the closed loop formed by the cross strap and the outer strap is tightened onto the pole.

One preferred embodiment of the invention will now be described, by way of example, with reference to the accompanying drawings. In the drawings.

Figure 1:
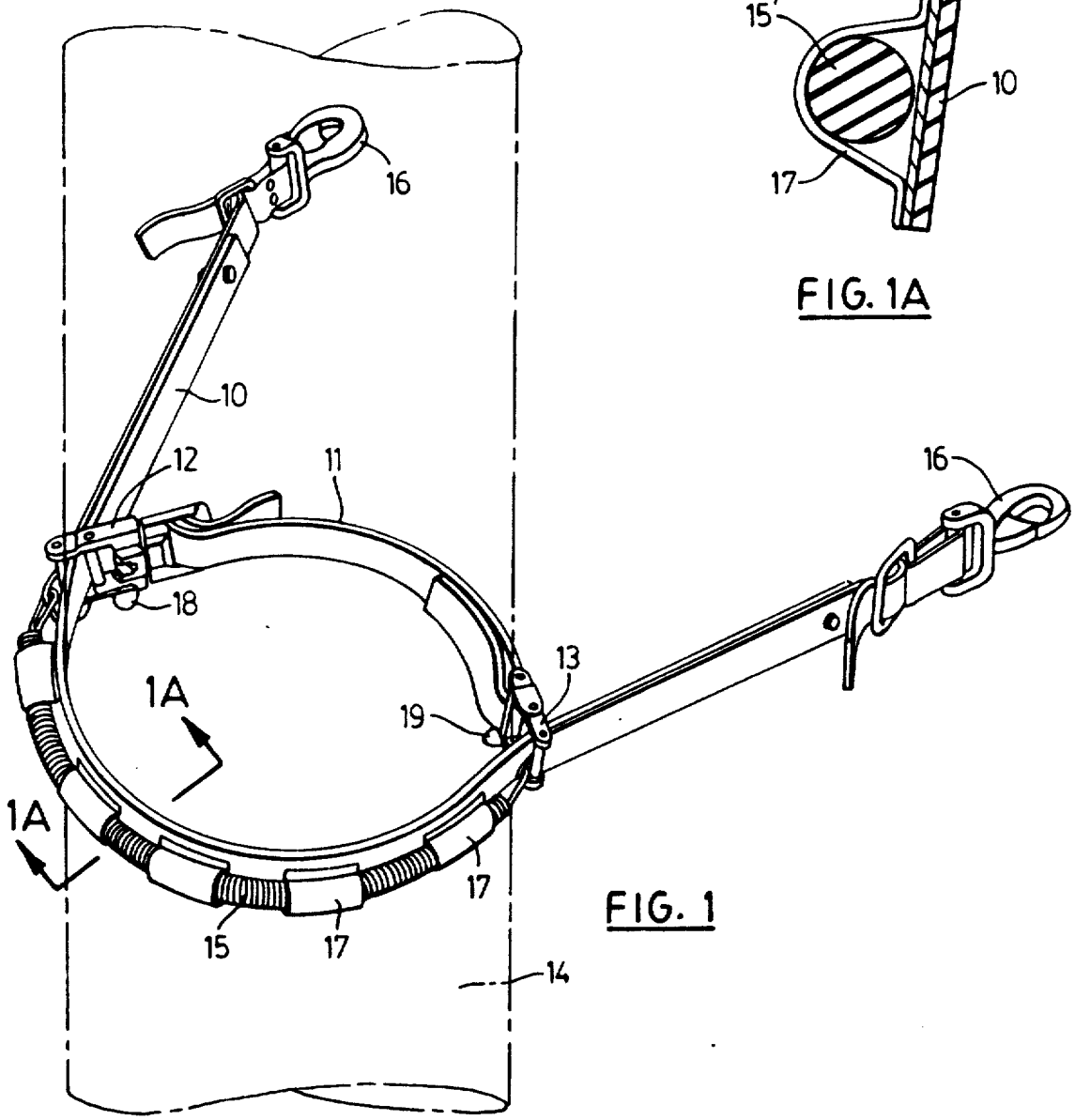
FIG. 1 is a perspective view of the pole strap assembly shown in relation to a utility pole, the cross strap having been released into engagement with the pole.

Referring to the drawings, and more particularly to FIG. 1 thereof, a lineman's pole strap assembly according to the invention comprises an outer strap 10, a cross strap 11 secured at its ends to slide members 12, 13 which are slidably mounted on the outer strap 10, thus defining with an intermediate portion of the outer strap 10 a closed loop which encircles the utility pole 14. The slide members 12, 13 are interconnected by an elastic tensile member 15 under tension which serves to pull the slide members along the outer strap and so draw the cross strap into tight frictional engagement with the near side of the pole, as shown in FIG. 1.

The outer strap 10 is a pole strap of the conventional type made of relatively stiff but flexible material, such as synthetic fibre or leather, and is adapted to extend around the far side of the utility pole when in use. The outer strap 10 has snap hooks 16 at its ends by which it can be attached to rings provided on the lineman's body belt (not shown). The inner surface of the outer strap 10 is of a material which frictionally engages the pole 14 when pulled against it.

Figure 1A:
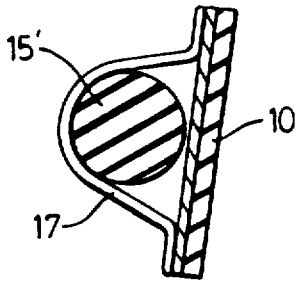
FIG. 1A shows a detail of a modified assembly, corresponding to a cross sectional view on line A—A in FIG. 1.
Figure 2:
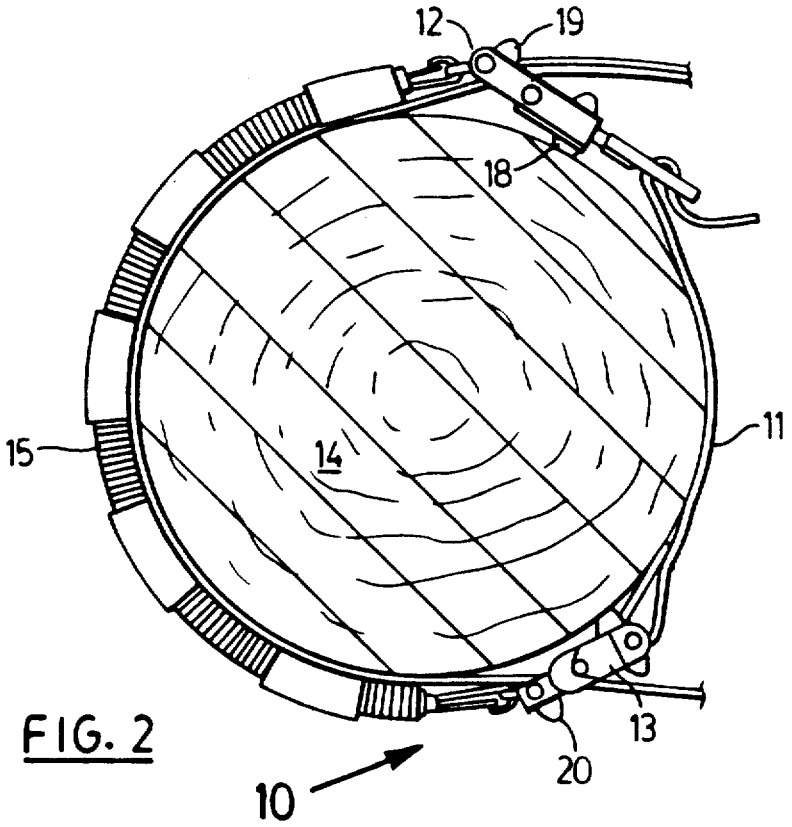
FIG. 2 is a cross sectional plan view of the assembly shown in FIG. 1.
Figure 3:
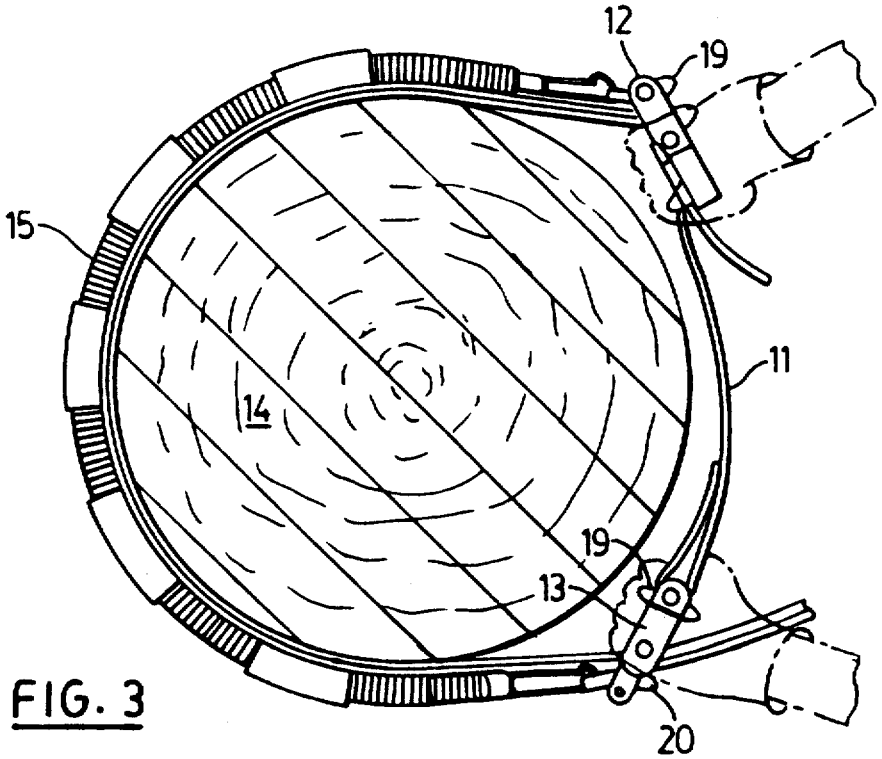
FIG. 3 is a view similar to FIG. 2 but with the cross strap held manually away from the utility pole.

The elastic tensile member 15, which is a coil spring in the present embodiment, but which may alternatively be a bungee cord 15' or the like as shown in FIG. 1A, is mounted on the outer strap 10 by loops 17 of leather or other flexible material stitched onto the outer strap 10. The member 15 is passed through the loops 17 so as to extend around the intermediate portion of the outer strap along its outer surface, thus serving to pull the cross strap against the pole 14. However, during normal ascent and descent of the pole the lineman must manually grasp the slide members 12, 13 and hold the cross strap away from the pole, as shown in FIG. 3, so that the pole strap can be manipulated in the normal manner. When the slide members are released, as when the lineman reaches a working position, or in the event that he loses his footing while ascending or descending, the closed loop formed by the cross strap 11 and the outer strap 10 is closed into tight frictional engagement with the utility pole 14, thereby pulling gaffs 18, 19, which are mounted on the slide members 12, 13, into biting engagement with the pole.

Figure 4:
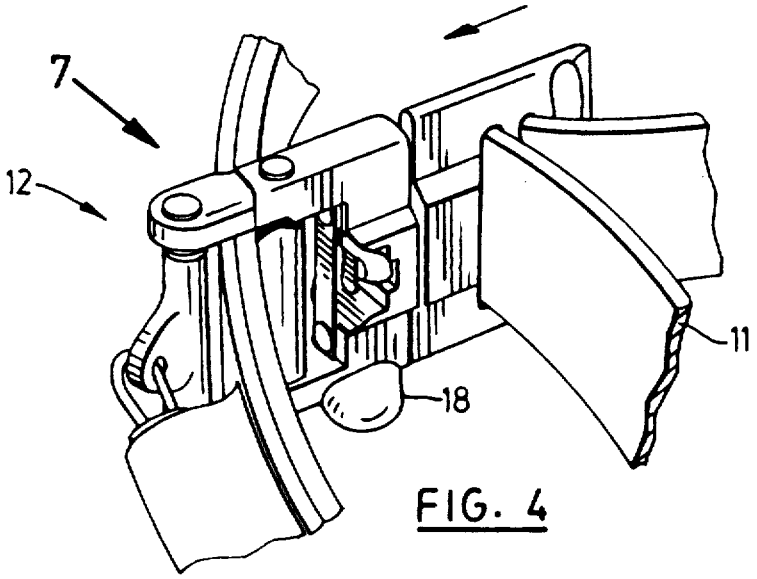
FIGS. 4, 5 and 6 show details of a slide member and the manner of its attachment to the cross strap.
Figure 5:
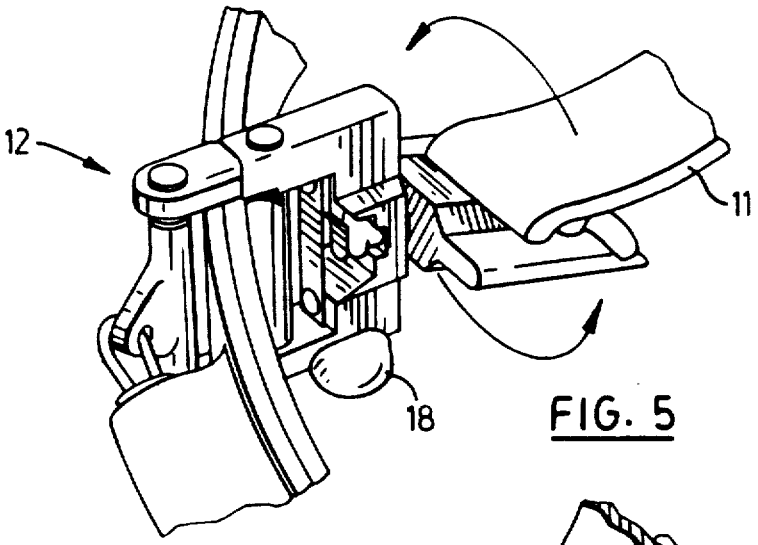
Figure 6:
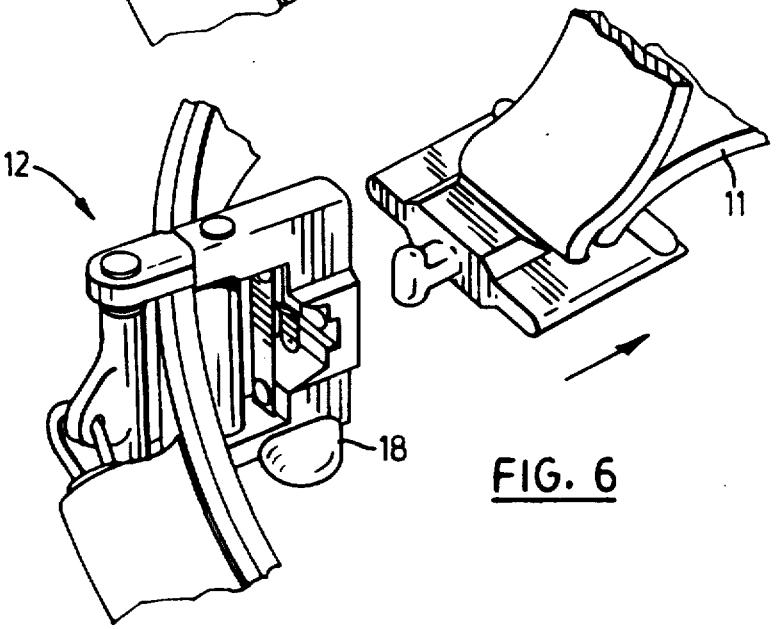
Figure 7:
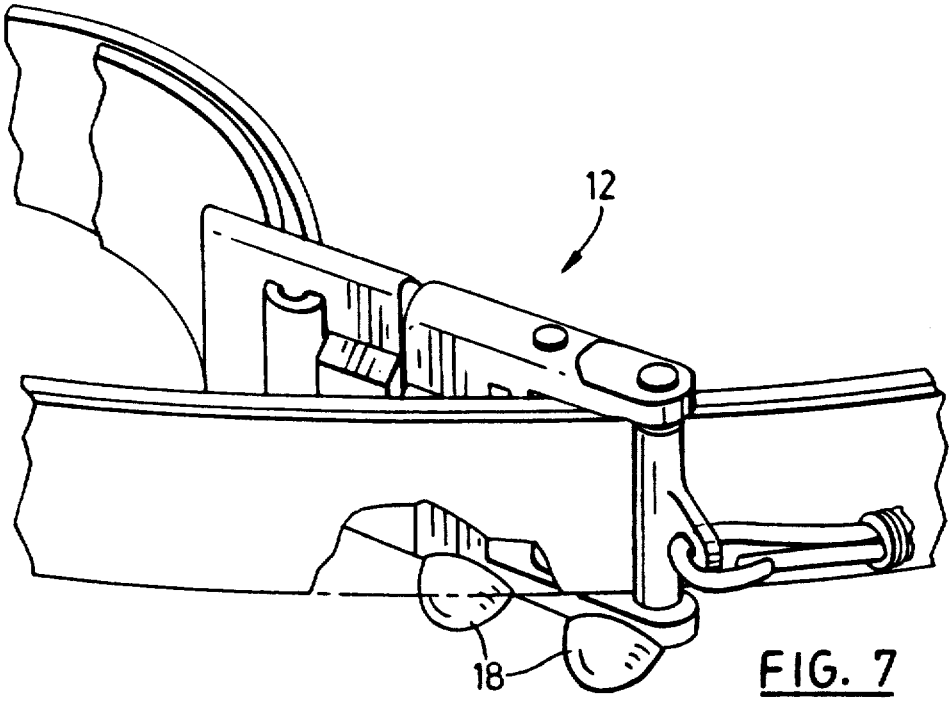
FIG. 7 is a scrap perspective view taken in the direction of arrow 7 in FIG. 4.
Figure 8:
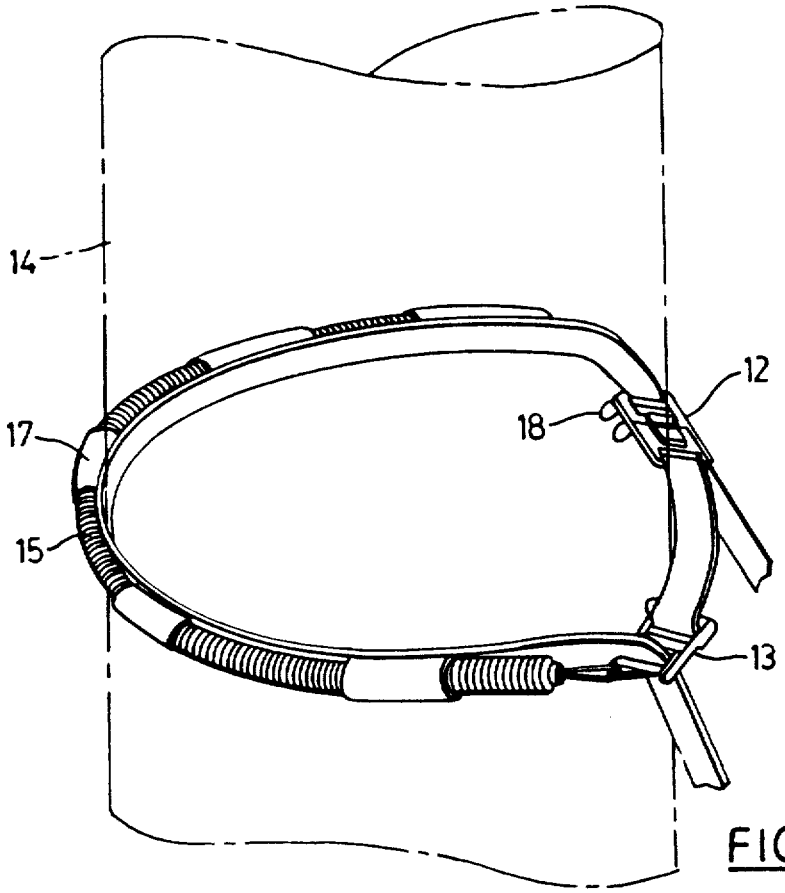
FIG. 8 is a scrap perspective view, similar to FIG. 1, but showing a condition in which the cross-strap has become twisted.

It is, of course, necessary that the cross strap 11 be capable of being fastened and unfastened. This can be achieved by forming the cross strap in two parts to fasten together, but in the illustrated embodiment of the invention one end of the cross strap is attached to the outer strap 10 by means of the slide member 12, which is constructed as a two-part releasable coupling as best shown in FIGS. 4, 5 and 6. In this construction one coupling member 12A is slidably mounted on the outer strap 10 while the other coupling member 12B is attached to one end of the cross strap 11. The coupling member 12A comprises a yoke 12C with a pair of pins 12D, 12E extending between the arms of the yoke and defining a slot through which the outer strap 10 extends. At least one downwardly depending gaff 18 formed on the lower yoke arm is provided for engaging the pole 14 when it is pulled against it. The base of the yoke 12C is formed with an internal groove 12F which communicates with an external key slot (not shown) at right angles to it. The key slot is adapted to receive a correspondingly shaped headed pin 12G extending from the coupling member 12B. As best shown in FIGS. 4, 5 and 6, one end of the cross strap 11 is fastened to the coupling member 12B which provides a pair of additional slots through which the end portion of the cross strap extends, the arrangement being such that the length of the cross strap can readily be adjusted. To fasten the coupling the lineman inserts the headed pin into the key hole, turns it through 90° as indicated in FIG. 5, and releases the member 12B so that the pin becomes nested in the groove 12F where it is retained by a leaf spring 19.

The other slide member 13 comprises a yoke with a pair of pins mounted between the yoke arms so as to define a slot through which the outer strap passes, the other end of the cross strap 11 being permanently attached directly to the slide member 13.

Figure 9:
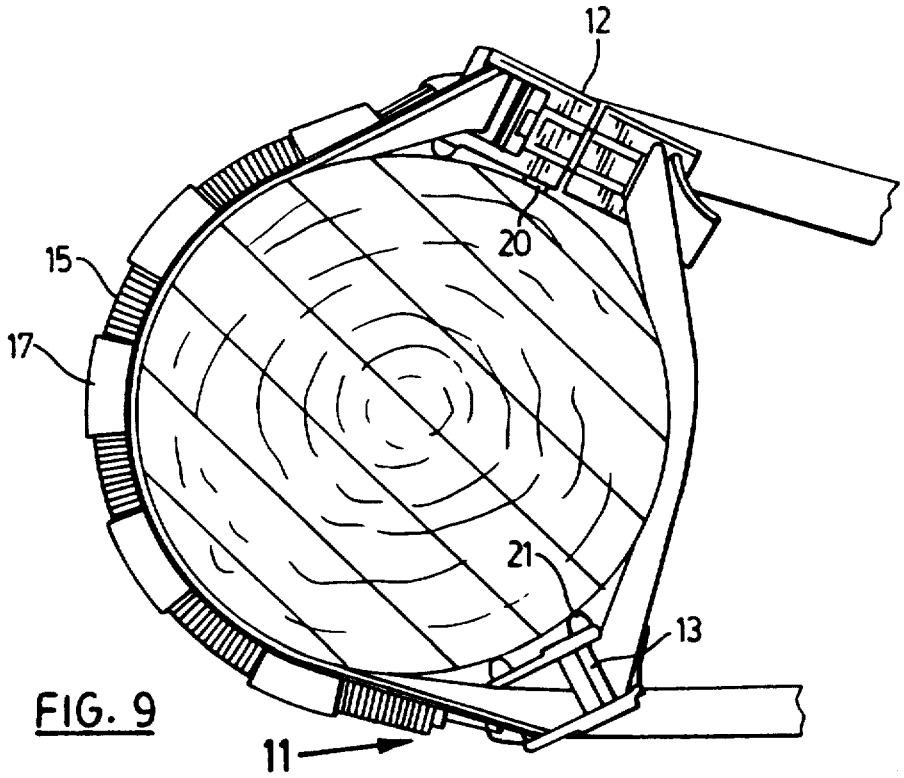
FIG. 9 is a sectional plan view, similar to FIG. 9.
Figure 10:
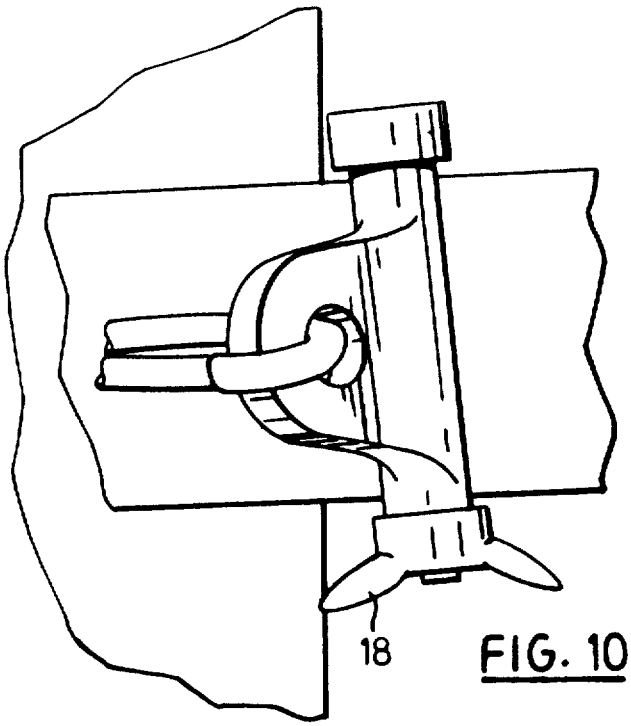
FIG. 10 is an enlarged scrap elevation in the direction of arrow 10 in FIG. 2.
Figure 11:
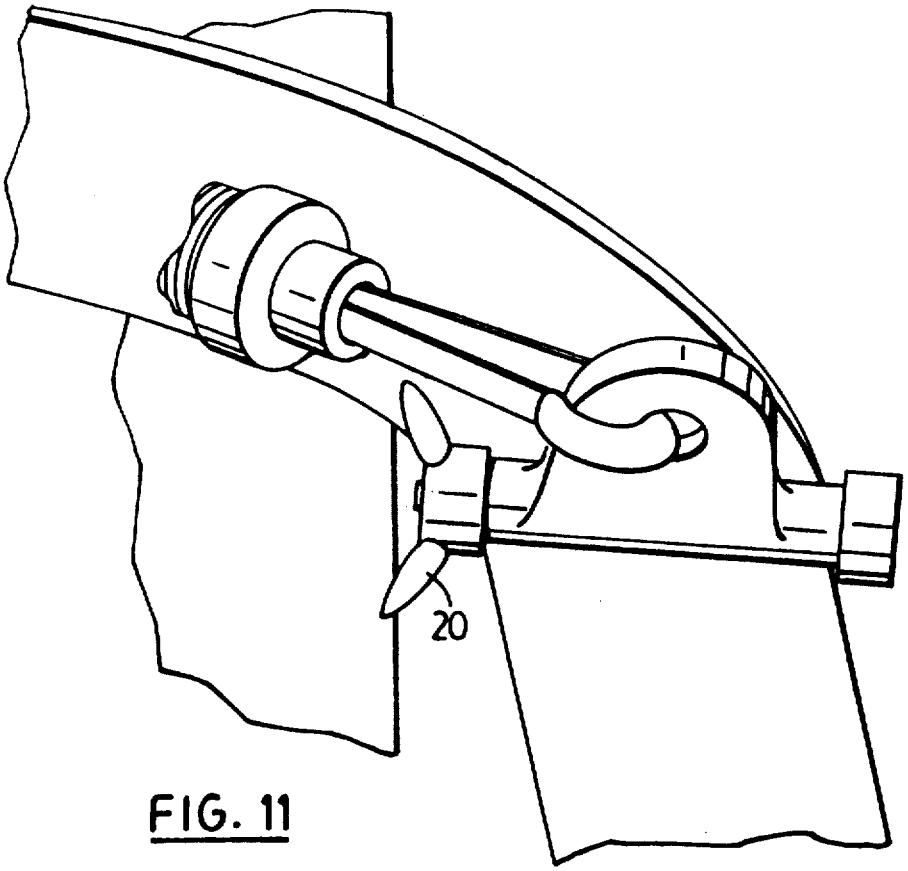
FIG. 11 is an enlarged scrap elevation, similar to FIG. 10, but illustrating the condition in which the cross-strap has become twisted.

An important feature of the present invention is that additional gaffs 20, 21 are provided on the slide members 12, 13 for engaging the surface of the pole 14 in the event that the cross-strap becomes twisted so as to turn the slide members over. This condition may arise in the special case in which the lineman loses his footing at the moment he is flipping the pole strap from between successive positions on the pole. The gaffs 20, 21 are formed on the slide members 12, 13 on the sides opposite to the gaffs 18, 19, and are positioned so as to turn inwardly and downwardly if the slide members are turned over thus being brought into biting engagement with the pole 14 should this condition arise. The condition is illustrated in FIGS. 9 and 11.

To sum up, the invention provides a pole strap assembly in which the pole strap and an associated cross-strap are interconnected in such a way as to form a closed loop encircling the pole, the loop being closed automatically into tight engagement with the pole when the cross strap is released by the lineman, should he lose his footing on the pole. The cross-strap is connected to the pole strap by slide members which are interconnected by an elastic tensile member, and the slide members are provided 10 on their opposite sides with gaffs positioned to bite into the pole which the cross-strap is released.

We claim:

1. A lineman's pole strap assembly comprising:

an outer strap of relatively stiff but flexible material adapted to extend loosely around the far side of a pole to be climbed and having end portions providing end attachment means for attachment to a body belt worn by a lineman, said outer strap having an outer surface, and an inner surface which frictionally engages the far side of the pole when pulled thereagainst, a cross strap secured at its ends to slide members which are slidably mounted on the outer strap, thereby defining with an intermediate portion of the outer strap a closed loop for encircling the pole, and an elastic tensile member mounted on and extending around the intermediate portion of the outer strap along the outer surface thereof, said elastic tensile member interconnecting the slide members, and said cross strap being manually movable away from the pole to permit climbing but releasable whereby, in the event of a fall, the cross strap is automatically drawn into frictional engagement with the pole by said elastic tensile member thereby tightening said closed loop onto the pole.

2. A lineman's pole strap assembly according to claim 1, wherein said slide members are formed with integral downwardly depending gaffs adapted to bite into the pole when pulled thereagainst.

3. A lineman's pole strap assembly according to claim 2 in which each side slide member is formed with integral oppositely directed gaffs on its opposite sides whereby to ensure that the gaffs on one or other side of the slide member are brought into biting engagement with the pole regardless of twisting of the cross-strap in the event of a fall.

4. A lineman's pole strap assembly according to claim 2, wherein at least one of said slide members comprises a two-part releasable coupling, one coupling part being slidably mounted on the outer strap and the other coupling part being attached to one end of the cross strap.

5. A lineman's pole strap assembly according to claim 2, wherein the elastic tensile member extends through loop elements stitched onto the outer surface of the outer strap.

6. A lineman's pole strap assembly according to claim 2, wherein the elastic tensile member is a coil spring.

7. A lineman's pole strap assembly according to claim 1, wherein the cross strap is readily adjustable in length.

* * * * *